US006026827A

United States Patent [19]

Revais

[11] Patent Number: 6,026,827

[45] Date of Patent: Feb. 22, 2000

[54] HAIR CLIP

[75] Inventor: Gerard Revais, Oyonnax, France

[73] Assignee: Societe Robert Revais, Oyonnax, France

[21] Appl. No.: 09/142,465

[22] PCT Filed: Mar. 28, 1997

[86] PCT No.: PCT/FR97/00571

§ 371 Date: Sep. 21, 1998

§ 102(e) Date: Sep. 21, 1998

[87] PCT Pub. No.: WO97/36513

PCT Pub. Date: Oct. 9, 1997

[30] Foreign Application Priority Data

Mar. 29, 1996 [FR] France ..... 96 04213

[51] Int. Cl.[7] ..... A45D 8/20

[52] U.S. Cl. ..... 132/277; 132/133; 132/138; 132/277; 132/276; 132/279

[58] Field of Search ..... 132/128, 131, 132/132, 133, 138, 277, 275, 278, 279, 276, 280, 273; D28/32, 39, 40, 41

[56] References Cited

U.S. PATENT DOCUMENTS

| | | | |
|---|---|---|---|
| 5,494,060 | 2/1996 | Potut | 132/277 |
| 5,520,201 | 5/1996 | Hart et al. | 132/277 |
| 5,549,127 | 8/1996 | Chang | 132/277 |
| 5,642,740 | 7/1997 | Chen | 132/277 |
| 5,697,388 | 12/1997 | Chang | 132/277 |
| 5,735,296 | 4/1998 | Chen | 132/277 |
| 5,787,905 | 8/1998 | Yasuda | 132/277 |
| 5,803,096 | 9/1998 | Lee | 132/277 |
| 5,842,485 | 12/1998 | Potut | 132/277 |
| 5,862,815 | 1/1999 | Murphy et al. | 132/277 |

*Primary Examiner*—Gene Mancene
*Assistant Examiner*—Philogene Pedro
*Attorney, Agent, or Firm*—Oliff & Berridge, PLC

[57] ABSTRACT

The hair clip includes two comb-shaped elements pivotably mounted in relation to each other and held in a brought-together state by an elastic member. Each comb-shaped element has teeth arranged on an end of the element. A first set of teeth has at least one opening in which a corresponding tooth from a second set of teeth engages when the cone-shaped elements are in a completely or a partially brought-together position to adequately clamp the hair.

8 Claims, 2 Drawing Sheets

HAIR CLIP

BACKGROUND OF THE INVENTION

The present invention relates to a hair clip.

It is well-known for a hair clip to be used for holding hair or for fashioning a hairstyle.

Such a clip comprises two comb-shaped elements mounted pivotably in relation to one another, which are usually held in a brought-together position by an elastic member such as a kickover spring. The teeth of these two elements have a shape which is curved to a greater or lesser extent and are offset from one element to the other so as to interlock when the two elements are brought together.

This type of clip has the disadvantage of not holding very well in the hair and of tending, therefore, to slide when the head is moved.

Indeed, these movements generate a centrifugal force on the clip in the opposite direction to that of the teeth which causes the two comb-shaped elements to move apart on account of the curved shape of the teeth and the weak elastic force of the spring.

Moreover, such a clip does not perform very effective holding of the hair on account of the fact that the teeth are not interlocked, or are only weakly interlocked, when the clip is placed in the hair. The hair is not held very well by these teeth and can escape relatively easily from the clip.

The present invention aims to eliminate these disadvantages.

SUMMARY OF THE INVENTION

The clip to which the invention relates comprises, in a manner known per se, two comb-shaped elements mounted pivotably in relation to one another and usually held in a brought-together position by an elastic member.

According to the invention, the teeth of one comb-shaped element are arranged opposite the teeth of the other comb-shaped element and one of two opposite teeth has at least one opening in which the other tooth engages when the two elements are in the completely or partially brought-together position.

Thus, the teeth of the two comb-shaped elements do not interlock but interpenetrate when the clip is completely or partially closed. The mass of hair gripped between the two elements tends to press the teeth against one another, thus generating friction between the teeth and creating a self-locking effect of the elements. This self-locking effect makes perfect holding of the clip in the hair possible even in the event of relatively sharp movements of the head.

Moreover, the longitudinal edges of the teeth come close to one another when the clip is completely or partially closed and together delimit numerous chicanes for clamping the hair. These chicanes make a clamping of the teeth in relation to one another possible, and this brings about the immobilization of the comb-shaped elements and contributes to good holding of the clip in the hair.

Preferably, the teeth have a base part of relatively slight curvature, an intermediate part of relatively great curvature extending over an arc of roughly 90°, and a free end part of relatively slight curvature.

The free end parts of two opposite teeth thus interpenetrate at a great angle, which favors the coming into mutual contact of these teeth during gripping of the hair and, therefore, the self-locking effect.

The teeth may have any shape that is suitable for increasing the clamping of the hair between them.

Thus, the opening made in one tooth may be of oval, oblong or triangular shape, or may comprise, on the same side as the free end of the tooth, a widened part favoring the introduction of the tooth situated opposite and, on the same side as the base of the tooth, a narrowed part favoring the clamping of the hair. The same tooth may also have two openings aligned longitudinally, in which the tooth situated opposite engages successively during the bringing-together of the two comb-shaped elements.

As for a tooth without an opening, this may have a non-rectilinear shape and/or a section which is variable over its length, favoring the arrangement of chicanes for clamping the hair. This tooth may also have an undulating shape, or a succession of widened portions and narrowed portions, or on the other hand a widened part at its base and a narrowed free end part which are intended to interact with an opening of corresponding shape.

The distribution of the teeth from one element to the other can be any required. Thus, the teeth comprising one or more openings and the teeth without an opening may be alternated on one and the same element, in a regular manner or not, or all the teeth comprising an opening may be arranged on the same element, while the other element comprises all the teeth without an opening.

The body of the elements itself may have any decorative shape.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
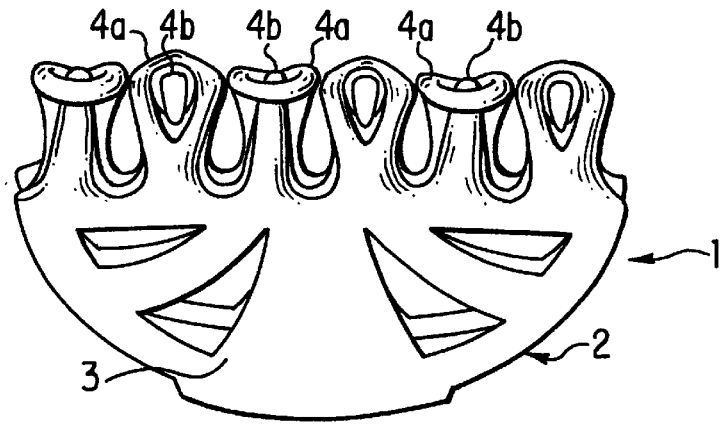
FIG. 1 is a perspective view of the clip according to one embodiment of the invention.
Figure 2:
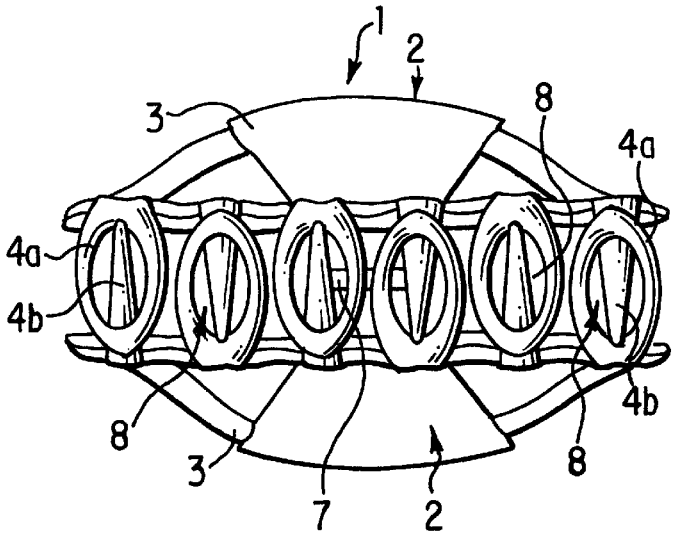
FIG. 2 is a bottom plan of the clip.
Figure 3:
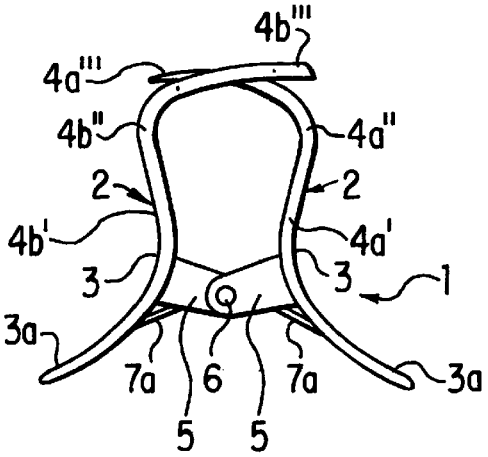
FIG. 3 is a side view of the clip.

FIGS. 1 to 3 illustrate the hair clip 1 according to the invention holds hair or fashions a hairstyle.

The clip 1 comprises two comb-shaped elements 2 each having a body 3 of any decorative shape and a series of teeth 4*a*, 4*b*.

Each body 3 is equipped on its inner face with two lugs 5 perforated by coaxial holes. The holes of the four lugs 5 are brought into alignment and receive a spindle 6 which makes it possible to assemble, with the possibility of pivoting, the two elements 2.

A kickover spring 7 comprising two legs 7*a* is engaged on the spindle 6, between the lugs 5. These legs 7*a* rest against the bodies 3 and usually hold the two elements 2 in a position in which they are brought close together.

As shown in particular in FIG. 3, those ends 3*a* of the bodies 3 which are opposite the teeth 4*a*, 4*b* are curved toward the outside and make it possible, by manual pressure exerted on them, to make the two elements 2 pivot counter to the elastic force of the spring 7 in order to open the clip 1.

It can be seen in FIGS. 1 and 2 that the teeth 4*a* of one element 2 are arranged opposite the teeth 4*b* of the other element 2 and that the teeth 4*a* have oval openings 8 in which the teeth 4*b* of tapering shape are engaged when the two elements 2 are in the completely or partially brought-together position.

FIG. 3 shows moreover that the teeth 4*a*, 4*b* each have a base part 4*a*', 4*b* ' of slight curvature, indeed of virtually rectilinear shape even, an intermediate part 4*a*", 4*b* " of relatively great curvature extending over an arc of roughly 90°, and a free end part 4*a*'", 4*b*'" of relatively slight curvature.

By virtue of the openings 8 and said shape of the teeth 4*a* and 4*b*, the free end parts 4*a*'", 4*b*'" interpenetrate at a great angle of the order of 170° when the clip 1 is completely or partially closed.

The gripping of a mass of hair between the elements 2 tends to press these parts 4*a*'", 4*b*'" against one another, bringing them into mutual contact at the ends of the openings 8. The friction thus generated makes it possible to create a self-locking effect of the elements 2 which brings about perfect holding of the clip in the hair even in the event of relatively sharp movements of the head.

Moreover, by virtue of the openings 8, numerous longitudinal edges are created in the region of the teeth 4*a*, 4*b*, and which come close to one another when the clip 1 is completely or partially closed. These edges together delimit numerous chicanes for clamping the hair. This clamping brings about the relative immobilization of the elements 2 and contributes to good holding of the clip 1 in the hair.

FIGS. 4 and 5 show that the teeth of the elements 2 may have any shape suitable for increasing the clamping of the hair between them.

Accordingly, FIG. 4*a–f* show a number of teeth 40*a* having one or more openings of different shape.

Figure 4A:
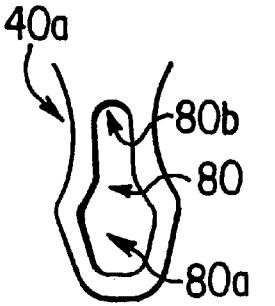
FIGS. 4*a–f* and 5*a–c* are views of various configurations of the teeth of the clip.

FIG. 4*a* illustrates a tooth 40*a* with an opening 80 having, on the same side as the free end of the tooth, a widened part 80*a* favoring the introduction of the tooth situated opposite, and, on the same side as the base of the tooth, a narrowed part 80*b* favoring the clamping of the hair.

Figure 4B:
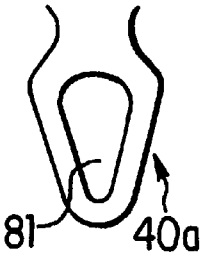

FIG. 4*b* illustrates a tooth 40*a* with an opening 81 having a substantially triangular shape.

Figure 4C:
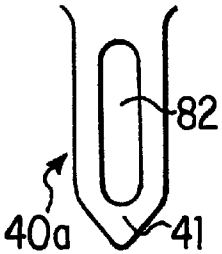

FIG. 4*c* illustrates a tooth 40*a* with an opening 82 having an oblong shape and pointed end part 41.

Figure 4D:
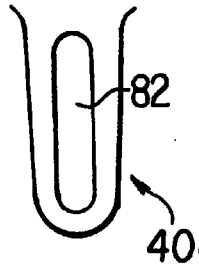

FIG. 4*d* illustrates a tooth 40*a* having an oblong shape without the pointed end part.

Figure 4E:
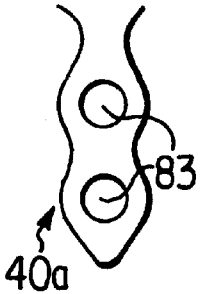
Figure 4F:
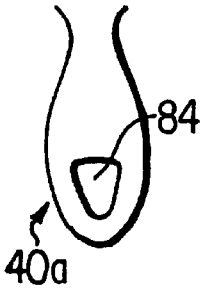

FIG. 4*e* illustrates a tooth 40*a* with two openings 83 aligned longitudinally, in which the tooth situated opposite engages successively during the bringing-together of the two elements forming the clip.

An opening 84 of small size and of triangular shape arranged in the region of the free end of the tooth.

Figure 5C:
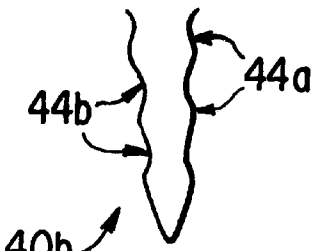
Figure 5B:
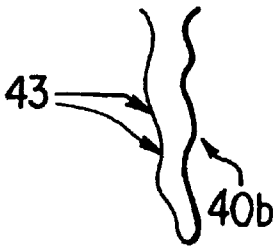
Figure 5A:
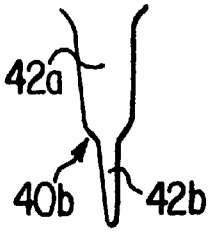

FIGS. 5*a–c* illustrate teeth 40*b* without an opening.

FIG. 5*a* illustrates a tooth 40*b* with a widened part 42*a* at their base and a narrowed free end part 42*b* which are intended to interact with an opening of corresponding shape, such as the opening 80.

FIG. 5*b* illustrates a tooth 40*b* with undulations 43.

FIG. 5*c* illustrates a tooth 40*b* having a succession of widened portions 44*a* and narrowed portions 44*b*.

The irregular shapes thus formed make possible the arrangement of additional chicanes for clamping the hair.

It is clear that the invention is not limited to the embodiments described above by way of example but that, on the contrary, it includes all the variant embodiments. Thus, other shapes of teeth than those shown in the drawing can be envisaged so long as they bring about a self-locking effect of the comb-shaped elements and adequate clamping of the hair.

Moreover, the distribution of the teeth from one element to the other can be any required. The teeth comprising one or more openings and the teeth without an opening may be alternated on one and the same element in a regular manner, as shown in FIGS. 1 and 2, or in an irregular manner, for example two or three teeth with an opening interposed with one tooth without an opening. All the teeth comprising an opening may just as well be arranged on the same element, while the other element comprises all the teeth without an opening.

The spring which usually holds the two elements 2 in the brought-together position may be of any type, in particular an elastic leaf or a helical spring.

I claim:

1. A hair clip comprising: a first comb-shaped element and a second comb-shaped element, the comb-shaped elements pivotably mounted in relation to each another and held in a brought-together position by an elastic member, a first set of teeth and a second set of teeth of one comb-shaped element are arranged opposite each other, each tooth of the first set of teeth has at least one opening in which each tooth of the second set of teeth engages when the comb-shaped elements are in one of a completely brought-together position and a partially brought-together position.

2. The hair clip according to claim 1, wherein the teeth of the first and second set of teeth each comprise an intermediate part having a curvature of approximately 90 degrees, a free end part and a base part, the free end part and base part each having a curvature less than the curvature of the intermediate part.

3. The hair clip according to claim 1, wherein the opening in each tooth of the first set of teeth is one of an oval shape, an oblong shape, a triangular shape and a geometric shape having a widened part favoring introduction of a corresponding tooth of the second set of teeth and a narrowed part favoring clamping of hair.

4. The hair clip according to claim 1, wherein the two openings in each tooth of the first set of teeth are aligned longitudinally so that a corresponding tooth of the second set of teeth each engage the two openings successively during the bringing-together of the comb-shaped elements.

5. The hair clip according to claim 1, wherein each tooth of the second set of teeth has at least one of a non-rectilinear shape and a variable length section.

6. The hair clip according to claim 5, wherein each tooth of the second set of teeth has one of an undulating shape, alternating widened portions and narrowed portions, and a widened part at a base and a narrowed free end part, the widened part and narrowed free end part interacting with the opening of a corresponding tooth of the first set of teeth having a corresponding shape.

7. The hair clip according to claim 1, wherein the teeth of the first and second set of teeth are alternatively arranged on a common comb-shaped element.

8. The hair clip according to claim 1, wherein the teeth of the first set of teeth are arranged on the first comb-shaped element and the teeth of the second set of teeth are arranged on the second comb-shaped element.

* * * * *